US006165238A

United States Patent [19]

Parkinson et al.

[11] Patent Number: 6,165,238

[45] Date of Patent: Dec. 26, 2000

[54] FUEL PELLET AND METHOD FOR ITS PRODUCTION

[75] Inventors: James W. Parkinson, Indiana; Glenn A. Shirey, Delmont; Thomas DiMuzio, Hollsopple, all of Pa.

[73] Assignee: CQ Inc., Homer City, Pa.

[21] Appl. No.: 09/330,997

[22] Filed: Jun. 14, 1999

[51] Int. Cl.[7] ..... C10L 5/14

[52] U.S. Cl. ..... 44/579; 44/553; 44/594; 44/595; 44/596

[58] Field of Search ..... 44/553, 594, 595, 44/596, 579

[56] References Cited

U.S. PATENT DOCUMENTS

| | | | |
|---|---|---|---|
| 3,836,343 | 9/1974 | Romey et al. . | |
| 4,369,042 | 1/1983 | Schäfer et al. . | |
| 4,529,407 | 7/1985 | Johnston et al. . | |
| 4,863,488 | 9/1989 | Maeda et al. | 44/589 |
| 5,244,473 | 9/1993 | Sardessai et al. . | |
| 5,453,103 | 9/1995 | Ford . | |
| 5,487,764 | 1/1996 | Ford, Jr. . | |
| 5,599,361 | 2/1997 | Ford, Jr. . | |
| 5,743,924 | 4/1998 | Dospoy et al. . | |
| 5,752,993 | 5/1998 | Eatough et al. . | |

*Primary Examiner*—Jerry D. Johnson
*Attorney, Agent, or Firm*—James L. Bean

[57] ABSTRACT

An improved pelletized fuel consisting essentially of from about 70% to about 98% coal fines and from about 2% to about 30% waste thermoplastic polymeric material (plastic) and a method of producing the improved pelletized fines are disclosed. The plastic is shredded or granulated before mixing with the coal fines, and the mixture is heated to a temperature to soften or melt at least a major portion of the plastic. The heated mixture is then shaped by applying a pressure of at least about 600 PSI and pressing the mixture through a pelletizing or extrusion die, or shaping the mixture in a briquetting operation.

16 Claims, 1 Drawing Sheet

FUEL PELLET AND METHOD FOR ITS PRODUCTION

BACKGROUND OF THE INVENTION

1. Field of the Invention

This invention relates to a process and formulation for producing fuel pellets or briquettes from fine sized coal and waste plastic, and to an improved fuel pellet made from fine sized coal and waste plastic.

2. Brief Description of the Prior Art

It has been estimated that over two billion tons of fine sized coal, i.e., coal having particle sizes of under about 0.5 mm, is contained in abandoned or active slurry impoundments in the U.S. While cleaning technologies exist to reduce the ash content of such coal fines to an acceptable level for fuel use, large quantities of such fines are still discarded because major users such as electric utility generating plants and industrial boiler operations place restrictions on the amount of fines in the coal that they purchased. The primary reason for these restrictions is that the fines normally contain a high percentage of moisture because of their high surface to weight ratio. The high moisture content results in serious handling problems because of the coal's stickiness, and its tendency to freeze in cold climates. If the fines are thermally dried, dust problems result and normal precipitation may quickly rewet the fines stored outdoors.

It is known that the problems in handling and burning coal fines can be reduced if the coal is pelletized. However, pelletizing coal fines has normally required use of an adhesive binder, or the use of very high forming pressure and/or high temperatures. As is known, coal particles do not naturally stick together unless heated to the point of becoming plastic, or about 650° F. for most coals, or unless the particles are compressed at extremely high pressures, normally over 20,000 PSI for most coals. Each of these alternatives are expensive and may present other problems. For example, heating coal to 650° F. or higher can cause evolution of volatiles contained in the coal and of course the pellets must be cooled at least to some extent before storage in bulk.

It is also well known that large quantities of used plastic materials, both recyclable and nonrecyclable, are landfilled in the U.S. and elsewhere. This plastic material has a relatively high heating value, suggesting its use as a fuel. Such plastic material can be successfully burned as a fuel in boilers especially designed for such use, but such boilers are expensive both to build and to operate. It is also known that plastics may be blended with coal before combustion in a conventional boiler type furnace, but the plastic often segregates during storage and handling thereby causing nonhomogeneous fuel mixtures to be fed to the boiler.

Since the heat content and ash characteristics of plastic and coal are very different, slugs of plastic (or coal) can cause wide variations in boiler efficiency and in stack emissions. While commercially available pulverizers are available for shredding or pulverizing waste plastics, large volumes or slugs of such plastics may cause problems in boilers. Also, such plastic material typically is more difficult to handle than coal, potentially causing plugging in chutes and bridging or plugging in bins.

It is known to produce compact fuel pellets, briquettes, or even synthetic fireplace logs from a blend or mixture of combustible materials including coal fines, cellulosic materials including waste paper and paper making sludge, sewage sludge, plastics, and other materials. While these materials may be satisfactory for certain uses, they generally have had certain drawbacks which limit their commercial utilization. For example, the compaction process, hereinafter generally referred to as briquetting, may be expensive and the compacts produced may lack sufficient strength for bulk handling and transportation, or may be insufficiently water resistant to permit outdoor bulk storage.

Numerous patents have issued on fuel pellets or fuel pelletizing processes, in which the pellets are formed from or include coal fines as a substantial portion of the final product. One such product and process is disclosed in U.S. Pat. No. 5,743,924 to Dospoy et al, assigned to the assignee of the present application. This patent discloses a fuel pellet, and its method of manufacture, in which the pellet contains coal fines in the amount of 60 to 80%, papermaking sludge in an amount of 10 to 30%, and low density polyethylene plastic film in the amount of 0.5 to about 15% by weight. The process involves shredding the plastic film, blending the mixture, and pelletizing at a pressure within the range of about 1,000 to 4,000 PSIG. The patent also discloses the use of about 5 to about 10% by weight of paper in addition to the paper-making sludge. While the process of this patent is in commercial use and the pellets are satisfactory for certain uses, the pellets do not possess the water resistance desired for prolonged external bulk storage or the strength desired to enable repeated mechanized handling for economical transportation.

Johnston et al U.S. Pat. No. 4,529,407 discloses an injection molded fuel pellet composed of 97 to 99% combustible material of which at least ½ is natural cellulosic material with the balance being a filler which could include coal in amounts not in excess of 30%, and from 1 to 3% plastic. The synthetic thermoplastic material is distributed throughout the fuel pellet as discrete particles. The pellet is formed in an extruder where the temperature of the pellet is controlled to assure softening of the plastic within the forming pellet without conglomeration. The synthetic thermoplastic material acts to mechanically bond the cellulosic particles together.

Sardessai et al U.S. Pat. No. 5,244,473 discloses a fuel briquette consisting of particles of coal, coke, or lignite bonded into briquettes by mixing the particles with a phenolformaldehyde resin and a polyisocyanate in the presence of an organic nitrogen containing catalyst, with the mixture being subjected to a briquetting process to form the phenolic-urethane polymer bonded and coated briquettes.

Romey et al U.S. Pat. No. 3,836,343 teaches the formation of smokeless carbon-containing briquettes wherein the smokeless carbonaceous material is mixed with an aqueous suspension of a copolymer of butadine-acrylonitrile and compressed to form smokeless briquettes.

U.S. Pat. Nos. 5,487,764, 5,453,103 and 5,599,361, all assigned to COVOL Technology, each disclose the use of a polymeric material as a binder in the formation of briquettes or pellets of carbonaceous material such as coke breeze, coal fines or revert material.

Of the prior art patents, the Dospoy et al patent and Johnston et al patent each employ a substantial portion of cellulosic material in addition to the coal fines. The Sardessai patent and the three patents assigned to COVOL, mentioned above, all employ relatively expensive thermoplastic materials as binders to react with the coal or other carbonaceous products. With the exception of the Dospoy et al patent, the amount of synthetic resin material employed in the final product is not sufficient to materially affect the final product as a fuel.

It is the primary object of the present invention to provide an improved method of forming a fuel pellet, utilizing only coal fines and waste plastic material to produce a high strength durable, water resistant fuel pellet suitable for use in coal fired furnaces or boilers.

Another object is to provide such a fuel pellet product suitable for burning in conventional coal fired furnaces or boilers and which avoids the disadvantages of burning coal fines or plastic alone, or a mixture of coal fines and plastics.

Another object is to provide such a fuel pellet which is economical to produce and which provides enhanced burning characteristics including an increased heating value, reduced ash content and reduced sulfur content over coal alone.

Another object is to provide an improved alternative to landfill disposal of waste plastics and to the utilization of waste coal fines currently contained in slurry impoundments.

Another object of the invention is to provide such an improved fuel pellet which may be produced without use of the extremely high pelletizing pressures and/or temperatures required for pelletizing coal alone.

Another object is to provide such an improved fuel pellet which avoids the necessity for use of high cost adhesive materials for bonding the coal fines in the pellet.

SUMMARY OF THE INVENTION

The foregoing and other objects and advantages of the invention are achieved in accordance with the present invention in which nonrecyclable post use or waste plastics including film plastic, polystyrene, plastic coated paperboard and other thermoplastic materials is combined with coal fines and processed through a commercial pelletizing mill to produce a high strength, durable water resistant fuel pellet. This is achieved by shredding or grinding the waste plastic materials to reduce the particle size and increase the bulk density of the plastic. Preferably after shredding, about 90% of the plastic will have a size to pass a 6 mesh screen although the size of the plastic particles may vary depending upon the rate of the processing and other parameters in forming the pellets. The coal fines and plastic material are then mixed together and heated to the softening or melting point of the plastic and the mixture fed to a pelletizer such as a commercial Kahl pellet press. The coal-plastic mixture may be heated together as during the mixing operation, or the coal may be heated initially and the plastic added to and mixed with the coal to produce a uniform mixture temperature at or above the softening or melting point of the plastic, with the mixing continuing to substantially coat the coal particles with the softened or melted plastic materials.

The heated coal-plastic mixture is fed directly to a commercial pelletizer and processed into pellets in the heated condition. The pellets discharged have sufficient strength immediately upon discharge from the pelletizer to resist breaking and retain their shape, and to quickly harden to produce a high strength, durable water resistant pellet. Preferably the pellets will contain from about 10% to about 30% plastic, but may contain as little as 2% plastic.

The terms "plastic" and "thermoplastic materials" are sometimes used interchangeably herein, it being understood that both are intended to refer to waste or post-use synthetic resin thermoplastic materials. Also, while the invention will be described with particular reference to a pelletizing operation, and the discrete compacted fuel particles referred to as pellets or pelletized fuel, it should be understood that these terms are intended to refer as well to briquetting or extrusion operations and to briquettes or extruded discrete particles.

BRIEF DESCRIPTION OF THE DRAWINGS

The foregoing and other objects and advantages of the invention will be apparent from the detailed description contained herein below, taken in conjunction with the single drawing FIGURE which is a schematic illustration of apparatus for carrying out the method of the present invention.

DESCRIPTION OF THE PREFERRED EMBODIMENTS

Figure 1:
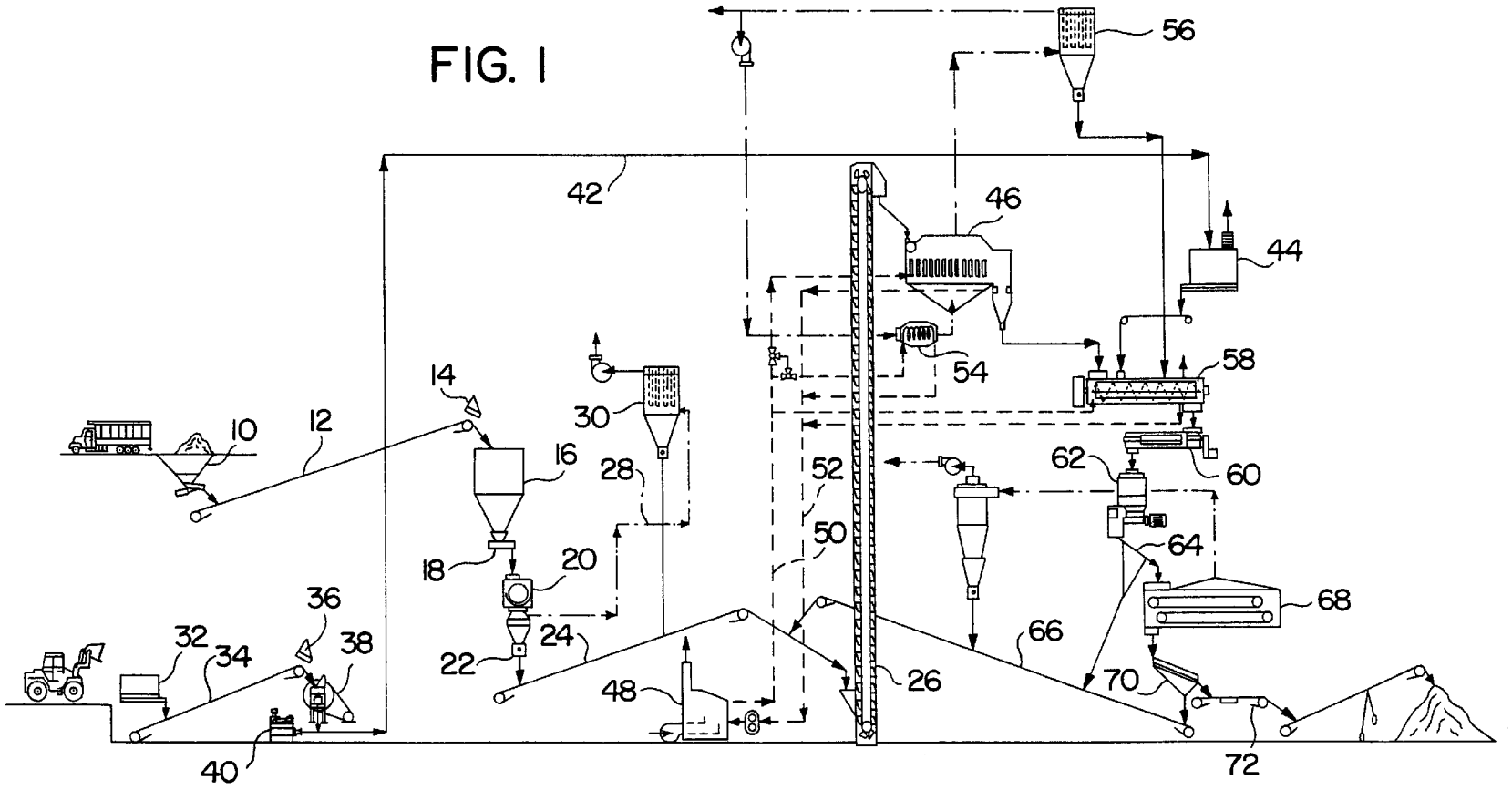

Referring now to the single drawing, a facility for the production of pellets in accordance with the process of the present invention on a commercial scale is illustrated schematically. In this system, coal is received from a supply source into a vibratory feed hopper 10 which discharges the coal onto a coal conveyor 12 for transport, past a magnetic metal remover 14, to a storage bin 16. Coal, as received from the supply, is fed from storage 16 through a weighing feeder 18 to a hammermill or other suitable crusher 20 where the coal is crushed to eliminate any large size particles, for example, to a nominal 28 mesh top size. The coal fines from the crusher pass through an airlock 22 to a coal conveyor 24 for transport to a bucket type elevator 26. Dust and air from the hammermill, and from other material transfer points, may be withdrawn, as through a duct system 28 and passed through a baghouse 30 where coal dust or fine particles of coal are removed and returned to the conveyor 24 for delivery to the elevator 26.

Post use plastic, which preferably has previously been cleaned and compacted to increase its bulk density, is delivered to a receiving hopper 32 from the bottom of which it is fed onto a plastic feed conveyor 34 for movement past a magnetic metal removing device 36 and fed into a plastics granulator 38 for grinding or granulation, preferably to the extent that at least about 90% passes a number 6 mesh screen. The granulated plastic is then conveyed by blower 40 through a conduit system 42 to a plastics storage or surge bin 44.

Coal is delivered by the bucket elevator 26 at a uniform rate to a vibrating fluidized bed dryer/heater unit 46 where excess moisture is removed and the coal is heated to a temperature preferably equal to or above the softening or melting temperature of the waste plastics being employed. Heated gas is supplied to the dryer/heater 46 by a gas fired heater unit 48 through conduit or duct system 50 and returned through conduit 52 to the heater 48. Heat is also supplied to an air heater unit 54 which supplies air to the interior of coal dryer 46 to remove water vapor and control the temperature in the dryer/heater. This heated air exits the coal dryer to a second filter or baghouse for removing any dust or coal particles. The filtered air may then be returned to the inlet of heater 48 or discharged to the atmosphere.

Dried, heated coal is fed from the coal dryer 46 to a mixer unit 58, and a proportionate amount of granulated plastic is fed from the storage bin 44 to the mixer. Mixer 58 preferably is surrounded by an insulated jacket and is heated interiorly by heated gases from heater 48.

If the coal is heated to a sufficiently high temperature in the dryer 46, heat transferred from the coal to the plastic may be sufficient to heat the plastic to the softening or melting temperature as the coal and plastic are continuously stirred and mixed together in the mixer 58. In this instance, additional heat may not be required in the mixer, but the insulated jacket will prevent escape of heat through the mixer walls. Alternatively, of course, heat may be supplied to the mixer to assure adequate softening of the plastic, and the coal and plastic mixture are retained in the mixer for a time to assure a substantially uniform coating of the coal particles by the softened waste plastic.

From the mixer 58, the coal-plastic feed stock is passed through a metering screw type feeder 60 to a conventional commercial pellet mill 62. The pelletized material is discharged from the pelletizer onto a green pellet screen 64 where broken pellets and loose material is screened out and permitted to fall onto a recycle conveyor 66 for return to the entrance to the coal elevator. The formed pellets pass from the screen 64 into a pellet cooler where they are retained for a time sufficient to cool and strengthen the pellets.

From the pellet cooler 68, the cooled pellets are passed over a final pellet screen 70, then to a product conveyor 72 for transportation to a suitable storage pile. Any broken pellets from the final pellet screen 70 also pass to the recycle conveyor 66 for recycling through the system.

Tests have shown that, by heating the coal in the dryer heater 46, to a temperature of about 400° F., a pellet mixture of 70% coal and 30% waste granulated plastic mixed within the insulated mixer 58 will result in the plastic absorbing sufficient heat from the dried coal to soften or melt the plastic and produce a uniform, substantially homogeneous mass exiting the mixer 58 at a temperature sufficiently high to form strong pellets without the addition of heat in the mixer. It has also been shown that coal at a substantially lower temperature, mixed with the unheated plastic entering the insulated mixer, can be heated in the mixer sufficiently to soften or melt the plastic and coat the coal particles and produce a strong pellet. It is noted, however, that when a substantial portion of the heat required to soften the plastic is added in the mixer 58, a substantially greater retention time in the mixer is required. In either case, the blended softened plastic and coal is readily pelletized in the pellet mill 62 without use of excessive pressure and without excessive wear on the pellet mill components.

It is known that dried coal is extremely abrasive and difficult to push through die openings of a pelletizer, but the plastic apparently acts as a lubricant and the plastic coated coal is easily pushed through the pelletizer die.

While the plastic coats the coal particles, it does not bond to the metal of the mixer or pelletizer, but rather acts as a lubricant during pelletizing, thereby reducing energy requirements and equipment wear. While the softened plastic is sticky and may coat metallic components, no chemical bond is formed and the plastic can, when necessary, be easily scraped off. At the same time, it appears that some form of chemical bond may be formed between the molten plastic and the coal particles and that this bond remains strong after cooling of the formed pellets.

In order to prove the ability to pelletize a blend of coal fines and waste plastic, and to prove the increased strength, integrity and water resistance of pellets formed entirely from coal fines and waste plastics, a number of tests were conducted. Through the American Plastics Council, sample supplies of post use plastics were obtained from two separate sources, the first sample consisting of a mixture of rigid plastics and the second consisting of a mixture of plastic produce containers, cartons, crates, plastic juice bottles, film plastics, and other thermoplastic materials. Both samples were subjected to shredding or granulation operations by a commercial crusher and pulverizing company to determine the shredding characteristics of the plastics, and both samples were analyzed for the typical physical, chemical and combustion properties that coals are subjected to for use in utility and industrial boilers. The results of these tests are shown in Table 1.

TABLE 1

| | Sample 1 | Sample 2 |
|---|---|---|
| Proximate (Wt %) | | |
| Moisture | 0.33 | 0.18 |
| Volatile Matter | 96.05 | 98.33 |
| Fixed Carbon | 2.37 | 0.21 |
| Ash | 1.58 | 1.46 |
| Ultimate (Wt %) | | |
| Sulfur | 0.04 | 0.10 |
| Carbon | 79.44 | 83.51 |
| Hydrogen | 10.62 | 13.93 |
| Nitrogen | 0.16 | 0.05 |
| Ash | 1.58 | 1.46 |
| Oxygen | 8.16 | 0.95 |
| Heating Value (Btu/lb) | 15,807 | 18,633 |
| Chlorine (Wt %) | 1.74 | 0.15 |
| Ash Fusion Temperature (° F., Red/Ox) | | |
| Initial Deformation | 2250/2250 | 2095/2360 |
| Softening | 2270/2265 | 2115/2400 |
| Hemispherical | 2285/2280 | 2135/2425 |
| Fluid | 2320/2295 | 2155/2450 |
| Trace Elements (ppm) | | |
| Cadmium | 1.22 | <0.05 |
| Chromium | 5.14 | 8.93 |
| Manganese | 6.81 | 10.26 |
| Nickel | 1.25 | 4.25 |
| Lead | 12.30 | 8.57 |
| Arsenic | 0.42 | 0.29 |
| Selenium | 0.27 | <2.00 ppb |
| Mercury | <0.50 ppb | <0.50 ppb |
| Size Consist (Shredded, % passing) | | |
| ½" | 100.00 | 100.00 |
| ¼" | 99.98 | 99.76 |
| 4 mesh | 99.97 | 99.68 |
| 6 mesh | 93.69 | 95.17 |
| 10 mesh | 56.45 | 67.57 |
| 16 mesh | 24.65 | 28.20 |

By comparison, the approximate analysis of benefacted Appalachian bituminous coals may typically include 6 to 8% moisture, 16 to 35% volatile matter, 50 to 60% fixed carbon, and 6 to 12% ash, all percentages by weight. Such coals may typically have a heating value ranging between 12,000 and 14,000 BTUs per pound, as fired, and have a chlorine content of less than 0.2%.

The following examples illustrate the results of the tests conducted:

EXAMPLE 1

Bench scale tests were initially conducted by applicants' assignee to investigate product formulation and pelletization, including the required pelletizing conditions such as temperature, pressure and moisture content. Initial tests utilized a laboratory hydraulic press and a ¾" diameter cylindrical die to form pellets from a mixture of crushed bituminous coal from western Pennsylvania and the two samples of plastic materials described.

Product formulation, in coal-to-plastic ratio, by weight, ranged from 70/30 to 90/10 in the initial test, with press pressures of 2100 PSI which is typical for commercial pelletizing mills. Pellets formed at ambient temperature under these conditions measured only 1 to 2 Kg in strength as measured by a spring loaded Kahl pellet hardness tester. Striations and cracking were evident around the circumference of the pellet. Adding water to the mix failed to improve the strength. Using the Kahl hardness tester, pellet strength of at least 10 Kg are generally considered necessary for handling and transport requirements.

Tests were then conducted to evaluate the effect on pellet strength of applying heat to soften the plastic prior to pelletization, utilizing a laboratory muffle furnace to heat the mix and/or die. For these tests, coals from two different coal impoundments were used. Coal moisture content ranged from 2 to 19.5% and in the various tests, die pressures ranged from 500 to 3600 PSI, oven temperatures from 250 to 450° F., die temperatures from 250 to 425° F., and heating times from 0 to 15 minutes. Coal-to-plastic ratios tested were 70/30 and 80/20.

One series of tests were conducted in which the coal plastic mix was placed in a die and the die and mix heated in an oven for 10 to 15 minutes at oven temperatures ranging from 250 to 350° F. with die pressures of 2100 PSI. At 250° F. temperatures, very weak springy pellets were formed. Strong pellets (22 to 23 Kg) were formed at oven temperatures of 350° F. The temperature of the coal-plastic mixture was not measured for these tests.

Another series of tests were performed to evaluate the effect of die pressure on pellet strength at oven temperatures of 325 to 425° F., in 250 increments. Die pressures were varied from 600 PSI to 3600 PSI in 500 PSI increments. Again the mix was placed in the die and heated together inside the oven for approximately five minutes after the oven obtained the desired temperature. It was determined that pellet strength was not significantly affected by variations in die pressure within the range tested. Temperature was shown to be a significant factor, however, with pellet strength increasing from 12 to 15 Kg at 375° F. up to 45 to 65 Kg at 400° F. Again in these tests, only oven temperatures were recorded, i.e., no direct measurement of die or mixture temperature was attempted. Test results were similar using either 80/20 or 70/30 coal/plastic mixtures. Pellet strengths of over 50 Kg were produced at die pressures as low as 600 PSI.

Another series of tests were conducted to determine the impact on pellet strength of placing the coal-plastic mixture at ambient temperature into a preheated die immediately prior to pelletizing. A 70/30 mix was used, with air dried coal having a moisture content of 2%. Die temperatures ranged between 250° F. and 425° F. in 250 increments, and die pressure was 2100 PSI for all tests. Pellet strength gradually increased with die temperature, from less than 1 Kg at 250° F. to 18 Kg at 425° F.

A final series of these tests as conducted in which the coal-plastic mix was placed into a preheated die and then the die placed inside an oven and heated for periods ranging up to 5 minutes in 1 minute increments. Oven temperature was set at 350° F. with die/mix temperatures typically at 330° F. to 335° F. Pellet strength ranged from 10 Kg with no combined mixture and die heating up to 48 Kg with mixture and die heating times of 4 minutes.

Bench scale tests were also conducted by a commercial testing facility, utilizing a 70/30 mix for each plastic sample. The coal was air dried and crushed to a nominal 28 mesh top size. For these tests, the coal plastic mix was preheated in a drum warmer to 350° F. prior to pelletizing in a Kahl pellet press operating at 100 RPM and having a die opening length-to-diameter ratio of 5/1. Pellets produced in these tests from mixes utilizing both plastic samples described above achieved strengths in the range of 30/35 Kg after 3 minutes curing time when the mixes were heated to approximately 325° F. This strength increased with increased curing time, for example, one test showed an increase from 31 Kg after 3 minutes to 56 Kg after 10 minutes curing.

Attempts to produce pellets using the Kahl pelletizer and the mix just described, with a die opening length-to-diameter ratio of 3/1 did not successfully produce solid pellets.

EXAMPLE 2

Tests were also conducted by the commercial testing facility to determine the feasibility of producing acceptable pellets by heating and pelletizing mixtures of coal fines and post use plastics in commercial scale pelletizing equipment. A Kahl Model 33–390 pellet press and Littleford—Day Model FM-130D high density batch mixer were used for these tests. The mixer was equipped with a heating jacket supplied with 75 PSI steam, and the jacket was wrapped with insulation to reduce heat loss. In these tests, the temperature of the mixture ranged from 250° to 275° F., and it was determined that 20 to 40 minutes were required to heat the mix from room temperature to the desired final mix temperature in the steam heated mixer. These tests produced pellets having strength in the 20 to 25 Kg range when formed in the commercial pelletizer having a die opening length-to-diameter ratio of 5 to 1 and with the mix heated to a temperature of between 260° F. and 275° F.

Using this equipment, tests were also conducted in which the coal was initially heated and mixed with plastic at room temperature. The coal was heated to 265° F., plastic was added to the heated coal inside a mixer, and the mixture was stirred for 4 minutes, during which times the mixture temperature dropped to 230° F. These tests were considered unsuccessful in that very weak pellets were produced, accompanied by substantial fines, but further laboratory testing indicated that successful pellets could be formed by heating the coal to a higher initial temperature whereby the minimum mix temperature was increased. Laboratory testing also indicates that plastics containing a higher percentage of thermoplastic materials having a lower melting or softening point may also yield successful pellets at mixture temperatures as low as 100° C. (212° F.).

Laboratory testing has also indicated that with carefully controlled heating and mixing, pellets having coal-to-plastic weight ratios as high as 99/1, could be produced with a breaking strength of 15 Kg. The average breaking strength of pellets produced with 2% to 10% plastic was 21 Kg in these more carefully controlled tests. For these lower percentages of plastic, the breaking strength of the pellets was not as consistent as with greater plastic percentages. For high speed commercial pellet production, the percentage of plastic should be at least 2% and preferably should be at least about 10% up to about 30%. Mixes containing a larger percent of plastic may also be used to produce competent pellets, but the upper limit of plastic has not been adequately investigated nor has the effect of higher percentage of plastics on the burning characteristics of the pellets been investigated.

Pellets produced in accordance with Example 2, were analyzed for the chemical and physical parameters employed for the coal and plastics. Table 2 shows the analysis for the plastic, coal, and pellets.

TABLE 2

| (As-Received Basis) | Coal (70%) | Plastic-Sample 2 (30%) | Pellets (100%) |
|---|---|---|---|
| Proximate (Wt %) | | | |
| Moisture | 3.22 | 0.18 | 0.46 |
| Volatile Matter | 32.01 | 98.33 | 49.94 |
| Fixed Carbon | 52.55 | 0.21 | 39.96 |
| Ash | 12.22 | 1.46 | 9.64 |
| Ultimate (Wt %) | | | |
| Sulfur | 1.79 | 0.10 | 1.34 |
| Carbon | 71.04 | 83.51 | 76.10 |
| Hydrogen | 4.70 | 13.93 | 7.32 |
| Nitrogen | 0.99 | 0.05 | 0.96 |
| Ash | 12.22 | 1.46 | 9.64 |
| Oxygen | 6.04 | 0.95 | 4.18 |
| Heating Value (Btu/lb) | 12,805 | 18,633 | 15,708 |
| Ash Fusion Temperature (° F., Red/Ox) | | | |
| Initial Deformation | 2125/2520 | 2095/2360 | 2220/2490 |
| Softening | 2240/2570 | 2115/2400 | 2300/2535 |
| Hemispherical | 2340/2580 | 2135/2425 | 2360/2550 |
| Fluid | 2390/2595 | 2155/2450 | 2425/2575 |
| Trace Elements (ppm) | | | |
| Cadmium | 0.95 | <0.05 | <0.05 |
| Chromium | 24.89 | 8.93 | 32.53 |
| Manganese | 24.89 | 10.26 | 20.48 |
| Nickel | 31.23 | 4.25 | 25.54 |
| Lead | 9.67 | 8.57 | 13.97 |
| Arsenic | 24.49 | 0.29 | 21.60 |
| Selenium | 1.92 | <2.00 ppb | 1.32 |
| Mercury | 430 ppb | <0.50 ppb | 104 |
| Size Consist (% passing) | | | |
| ½" | 100.00 | 100.00 | |
| ¼" | 100.00 | 99.76 | |
| 4 mesh | 100.00 | 99.68 | |
| 6 mesh | ND | 95.17 | |
| 10 mesh | ND | 67.57 | |
| 16 mesh | ND | 28.20 | |
| 28 mesh | 65.37 | ND | |
| 100 mesh | 23.69 | ND | |
| 325 mesh | 13.07 | ND | |

The above analysis indicates that the reduction in moisture and the increase in heating value over coal alone should reduce total fuel consumption, but the pellets should burn similar to coal. Further, the reduction in ash could reduce plant ash disposal costs and the reduction in sulphur content should produce less $SO_2$ in the stack emissions while increasing the heating value over coal. Other advantages, including the reduction in $NO_x$ emissions, reduced boiler slagging due to improved ash characteristics and a reduction in trace elements in the stack emissions as compared to coal may be realized.

Pellets produced in accordance with the process in Example 2 were tested for water resistance. Pellets consisting of 90% coal and 10% waste plastic were air dried for one hour and found to have a strength of 62 Kg. These pellets were then placed in water. After one day in water, the pellets had a strength of 45 Kg, and after 20 days, the strength was 43 Kg.

It should be recognized that, since the invention utilizes waste plastic materials, the softening or melting temperature of all components of the plastic will not be the same. Accordingly, reference herein to heating the plastic to the softening or melting point should be interpreted to mean heating the material to melt at least a major portion thereof so that the coal particles will be coated with or adhere to the melted or softened plastic material.

While preferred embodiments of the invention have been disclosed and described, it is understood that the invention is not so limited, and it is intended to include all embodiments which would be apparent to one skilled in the art and which come within the spirit and scope of the invention.

What is claimed is:

1. A high strength, water resistant compacted solid fuel consisting of a substantially homogeneous mixture of coal fines in an amount of from about 70% to about 98%, by weight, and granulated waste thermoplastic polymeric materials in an amount of from about 2% to about 30%, said coal fines and thermoplastic polymeric material being bonded together to form discrete particles having a hardness of at least about 10 Kg as measured by a spring loaded Kahl pellet hardness tester.

2. The compacted solid fuel defined in claim 1, wherein the amount of coal fines in the fuel is from about 70% to about 90% and wherein the amount of thermoplastic polymeric material is within the range of 10% to about 30%.

3. The compacted solid fuel defined in claim 2, wherein the coal fines have a nominal top size of 8 mesh.

4. A method for producing a high strength water resistant pelletized fuel consisting of a mixture of coal fines in the amount of from about 70% to about 98%, by weight, and mixed granulated waste thermoplastic polymeric materials in the amount of from about 2% to about 30%, the method comprising the steps of heating the mixture of coal fines and thermoplastic polymeric materials to at least the softening point of the major portion of the thermoplastic polymeric material, mixing the heated coal and thermoplastic polymeric material to coat the coal fines with the melted thermoplastic polymeric material, pelletizing the heated mixture at a pressure of at least about 600 PSI, and cooling the pelletized fuel to form pellets having a strength of at least about 10 kg as measured by a spring loaded Kahl pellet hardness tester.

5. The method defined in claim 4, wherein the step of pelletizing the heated mixture comprises applying a pressure within the range of about 600 PSI to about 3600 PSI to the heated material to force the material through a pelletizer die opening.

6. The method defined in claim 4, wherein the step of pelletizing the heated mixture comprises applying a pressure of about 2,100 PSI to the heated material to force the material through a pelletizer die opening.

7. The method defined in claim 4, wherein said coal fines and said thermoplastic polymeric materials are heated to a temperature of at least about 212° F. before pelletizing.

8. The method defined in claim 4, wherein the coal fines and thermoplastic polymeric materials are heated to a temperature within the range of about 250° to about 350° F.

9. The method defined in claim 4, wherein the step of heating the coal fines and the thermoplastic polymeric material comprises initially heating the coal fines to a temperature above the melting temperature of the thermoplastic polymeric material, then adding the thermoplastic polymeric material to the heated coal fines and mixing the heated coal and thermoplastic polymeric material for a time sufficient for the thermoplastic polymer material to absorb heat from coal fines to melt at least the major portion of the thermoplastic polymeric material.

10. The method defined in claim 9, further comprising the step of mixing the heated coal fines and the thermoplastic polymeric material in a heated mixer.

11. The method defined in claim 4 wherein the step of heating the mixture comprises combining the coal fines and thermoplastic polymeric materials in a mixer, and mixing the combined materials while adding heat to the mixture in the mixer.

12. The method defined in claim 11 further comprising the step of heating and drying the coal fines prior to combining the coal fines and thermoplastic polymer materials.

13. The method defined in claim 4 wherein the pelletized fuel consists essentially of from about 70% to about 90% coal fines and from about 10% to about 30% thermoplastic polymeric materials, and wherein the method further comprises the steps of drying the coal fines by passing the coal fines through a heater/dryer and applying heat thereto before mixing with the thermoplastic polymer materials.

14. The method defined in claim 13 where the step of drying the coal fines includes heating the coal fines to a temperature above the melting point of at least a major portion of the thermoplastic polymeric materials.

15. The method defined in claim 14 wherein said coal fines are heated to a temperature of about 400° F. in the heater/dryer prior to mixing with said thermoplastic polymeric materials.

16. The method defined in claim 13 wherein the step of heating the mixture comprises combining the coal fines and thermoplastic polymeric materials in a mixer, and continuous mixing the combined materials while adding heat to the mixture in the mixer.

* * * * *